US007869934B2

(12) United States Patent
Breitenberger et al.

(10) Patent No.: US 7,869,934 B2
(45) Date of Patent: Jan. 11, 2011

(54) DETERMINATION OF AN EXPECTED SPEED LEVEL

(75) Inventors: Susanne Breitenberger, Munich (DE); Martin Hauschild, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 910 days.

(21) Appl. No.: 11/454,784

(22) Filed: Jun. 19, 2006

(65) Prior Publication Data

US 2007/0010934 A1 Jan. 11, 2007

Related U.S. Application Data

(63) Continuation of application No. PCT/EP2004/014643, filed on Dec. 19, 2003.

(30) Foreign Application Priority Data

Dec. 19, 2003 (EP) ..... PCT/EP03/14643

(51) Int. Cl.
*G08G 1/00* (2006.01)

(52) U.S. Cl. ..... 701/117; 701/119

(58) Field of Classification Search ..... 701/117, 701/118, 119; 340/995.13, 995.12
See application file for complete search history.

(56) References Cited

U.S. PATENT DOCUMENTS

2004/0039516 A1* 2/2004 Willembrock ..... 701/117

FOREIGN PATENT DOCUMENTS

DE 100 63 588 A1 7/2001
DE 102 19 531 A1 11/2003
EP 0 892 379 A2 1/1999
EP 1 216 888 A2 6/2002
EP 1 262 934 A2 12/2002
WO WO 02/07125 A1 1/2002

OTHER PUBLICATIONS

Machine translation of EP1262934 from EPO, 4 pages.*
International Search Report dated Mar. 22, 2005.

* cited by examiner

*Primary Examiner*—Khoi Tran
*Assistant Examiner*—Brian J Broadhead
(74) *Attorney, Agent, or Firm*—Crowell & Moring LLP

(57) ABSTRACT

A method provides traffic condition data in the context of a traffic condition recognition by a motor vehicle, in particular traffic condition data for detecting the position of traffic, preferably for detecting traffic jams. In a first step the type of road along which the vehicle is traveling is determined by use of a position recognition device and a digital road map. In a second step, the category of road along which the vehicle is traveling is determined by use of the position recognition device and the digital road map. A third step utilizes assignments, in particular a table, which assigns at least one lower speed threshold, one upper speed threshold and preferably also a normal speed to both the relevant road type and the relevant road category of the road along which the vehicle is traveling. Finally, in a fourth step, at least the lower speed threshold and the upper speed threshold are used to determine the traffic condition.

16 Claims, 6 Drawing Sheets

DETERMINATION OF AN EXPECTED SPEED LEVEL

CROSS-REFERENCE TO RELATED APPLICATIONS

This application is a continuation of PCT International Application No. PCT/EP2004/014218, filed on Dec. 14, 2004, which claims priority under 35 U.S.C. §119 to PCT International Application No. PCT/EP2003/014643, filed Dec. 19, 2003, the entire disclosures of which are expressly incorporated by reference herein.

BACKGROUND AND SUMMARY OF THE INVENTION

The invention relates to a method of providing traffic condition data, to a system for transmitting traffic condition data, to a device in a motor vehicle for generating and emitting traffic condition data and to a computer program product for use in a motor vehicle and for generating and emitting traffic condition data according to the preamble of the concerned independent claim.

Known vehicles send so-called floating car data (FCD). The system used for this purpose consists of a GPS receiver and a GSM module. Both modules already exist in many vehicles even without FCD functionality. The GPS receiver measures the position, and the FCD processes determine travel times of the vehicle from many of these position data. By means of the GSM network, these travel times are transmitted as bead chains (individual points of the driving route provided with space coordinates and time stamps) to the traffic data control center. The latter can draw conclusions on the traffic situation from these travel times. In this manner, a data inquiry takes place with respect to vehicle condition data for traffic information services.

The data transmission by way of the GSM network is connected with considerable costs.

In order to, in the future, determine the traffic situation more precisely and, in addition, by means of information concerning weather, road conditions and local dangers, FCD is further developed to XFCD (Extended Floating Car Data). XFCD utilizes the diverse sensors and subsystems present in the vehicle, which even now make their data available on central data buses in the vehicle. The analysis of the diverse data during the drive can provide information on traffic conditions, visual impairments, road conditions (road surface), conditions of infrastructure (winding roads), local dangers, precipitation, slickness and dangers connected with slippery road conditions.

An object of the invention particularly is a method of providing high-quality traffic condition data at acceptable cost.

An aspect of the method according to the invention for providing traffic condition data within the scope of a traffic condition recognition by a motor vehicle, particularly traffic condition data for detecting the traffic situation, preferably traffic condition data for detecting traffic jams, consists of the fact that, in a first step, the type of road on which the vehicle is traveling is determined by using the position recognition device and the digital road map; in a second step, the category of the road on which the vehicle is traveling is determined by using the position recognition device and the digital road map; in a third step, an assignment, particularly a table, is used which assigns at least one lower speed threshold and one upper speed threshold to the corresponding road type as well as to the corresponding category of the road on which the vehicle is traveling; and, in a fourth step, at least the lower speed threshold and the upper speed threshold, if required, in a modified form, are used for determining the traffic condition.

As a result of these measures, a better estimation of the situation is permitted through different speed categories. Thus, the falling of the speed below the lower speed threshold is an indication that the vehicle is moving in a traffic jam or is standing still. A speed of the vehicle which is in the range between the lower and the upper speed threshold is an indication that the vehicle is moving in a more undefined condition between a traffic jam and unimpeded travel. A speed of the vehicle which is higher than the upper speed threshold finally is an indication that the corresponding vehicle is traveling in an unimpeded fashion. By means of this classification, it becomes possible to differently weight the above-mentioned conditions and therefore permit a largely reliable detection of a jam also under several conditions which occur during the observation time for deciding whether or not a traffic jam is present.

This increases the acceptance with respect to using the method according to the invention as a result of the rising reliability and saves costs for transmitting false traffic jam reports from the vehicle to an institution, particularly a traffic data center, which reconstructs and displays the traffic situation. In particular, these consist of costs for corresponding SMS (short message service) messages or costs for other types of transmissions.

It is understood that the movement or the speed of the vehicle can also be divided into more than three speed categories or speed ranges. This may be meaningful particularly when a differentiation is to be made not only as to whether or not a vehicle is in a traffic jam but also at which points of the traffic jam which average speeds should be driven.

By this method, particularly for providing traffic condition data for detecting the traffic situation in the entire road system, preferably for detecting traffic jams, it becomes possible to largely reliably recognize a traffic condition and to transmit the traffic condition as an existing traffic situation only when it is currently occurring; that is, the method according to the invention makes it possible to generate traffic condition data in an event-oriented and condition-oriented fashion. Traffic condition data are transmitted only when this transmission is caused by the recognized traffic condition, for example, by a traffic jam.

As a result, the data traffic to an institution reconstructing and displaying the traffic situation, particularly a traffic data center, preferably by SMS, and the costs of the data transmission are limited to the minimum required for representing the traffic situation, without impairing the quality of the traffic situation detection.

In view of the above, it is only the method according to the invention which permits a cost-effective and even still contemporary data extraction by the vehicle for the entire road system, particularly on highways, country roads and on streets in city traffic.

As an alternative or in addition, it is provided in an embodiment of the invention that the road type and the category of the road on which the vehicle is traveling are provided by the known standard sensor interface, abbreviated "SSI", by using the local position of the vehicle provided in the vehicle and a road type assigned to the local position and a road category assigned to the local position.

As a result, no additional hardware or software is required for providing these data, which promotes a cost-effective implementation of the invention.

As an alternative or in addition, it is provided in an embodiment of the invention that the road types "highway", "fast road", "regional road", "main road", "local road", "connecting road", "slow road", "minor road", and "service road" are taken into account during the implementation of the method according to the invention.

As an alternative or in addition, it is provided in another embodiment of the invention that the road/street categories "in-town" "out-of-town" are taken into account during the implementation of the method according to the invention.

The consideration according to the invention of the above-mentioned road types and of the road category assigned to each of the road types permits a very precise classification of the expected speed level or of the lower and upper speed thresholds. This finally permits a largely reliable and nevertheless surface-covering detection of traffic jams on highways, country roads, city streets, etc.

As an alternative or in addition, it is provided in another embodiment of the invention that a normal speed is assigned to the determined road type as a function of the determined road category, and a lower speed threshold of approximately 35% of the normal speed and an upper speed threshold of approximately 45% of the normal speed are defined.

As an alternative or in addition, it is provided in another embodiment of the invention that speed values for a lower and an upper speed threshold defined as a function of the determined road category from a table of empirical values filed in the vehicle are assigned to the determined road type.

As an alternative or in addition, it is provided in another embodiment of the invention that current values for the lower and upper speed threshold, particularly as a function of the current vehicle position and of the time of day, are fed into the vehicle from outside the vehicle, particularly from a traffic data control center, and the current values are temporarily used instead of the original values.

The transmission of the current values for the lower and upper speed threshold for a route section which is currently being traveled or will soon be traveled preferably takes place into the vehicle by way of SMS, TMC, DAB or the like. The original data may be taken from a storage device in the vehicle (FIG. 6, 640), particularly a DVD, and only the currently deviating values are transmitted into the vehicle.

Vehicle-generated data are provided preferably every second to a computation algorithm by the vehicle data buses by means of a known standard sensor interface (FIG. 2, 201; FIG. 6, 630).

Furthermore, the method of obtaining data according to the invention permits the use of an advantageous system for the transmission of traffic condition data from a first vehicle to a second vehicle, particularly by way of an ad hoc network, or from a traffic data control center to one or more motor vehicles, if required, in a modified form, particularly by way of broadcasting. Likewise, it allows the use of an advantageous device and a computer program product in a motor vehicle for generating and emitting traffic condition data.

Other objects, advantages and novel features of the present invention will become apparent from the following detailed description of the invention when considered in conjunction with the accompanying drawings.

DETAILED DESCRIPTION OF THE DRAWINGS

Vehicle-generated data are provided preferably every second to a computation algorithm by the vehicle data buses by means of a known standard sensor interface. These are:

| | |
|---|---|
| Local coordinates | from: navigation system |
| road category | from: navigation system |
| distance to the nearest intersection | from: navigation system |
| distance to the end of the traveled road segment | from: navigation system |
| average normal speed | from: navigation system |
| in-town/out of town (type of road) | from: navigation system |
| speed | from: vehicle bus |
| steering angle | from: vehicle bus |
| gear | from: vehicle bus |
| warning flasher system, flasher | from: vehicle bus |
| ABS | from: vehicle bus |
| DSC/ASR | from: vehicle bus |
| crash sensor | from: vehicle bus |
| airbag | from: vehicle bus |
| door status | from: vehicle bus |
| next POI type | from: navigation system |
| distance POI | from: navigation system |
| temperature | from: vehicle bus |
| light | from: vehicle bus |
| fog light | from: vehicle bus |
| wiper adjustment | from: vehicle bus |
| wiping frequency | from: vehicle bus |
| hand brake | from: vehicle bus |

POI stands for "point of interest", such as restaurants, gas stations, hospital, etc.

Figure 1:
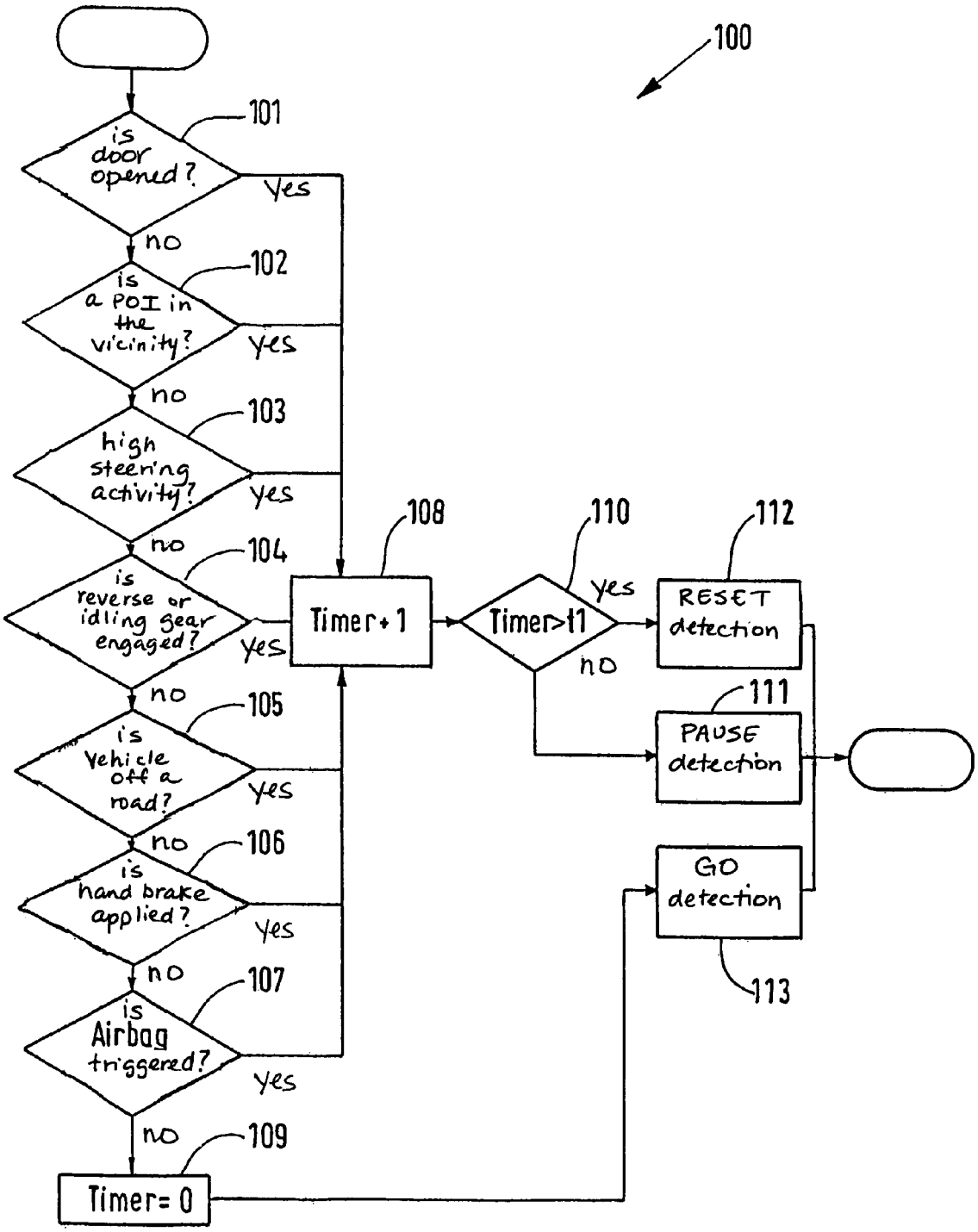
FIG. 1 is a flow chart of a software module for determining the scope of the determined traffic condition.

For checking the scope corresponding FIG. 1, it is determined by means of the local coordinates
road category
in-town/out of town (road type)
gear selection
door status
next POI type
distance of next POI
steering angle
hand brake
airbag
crash sensor data whether the vehicle is currently participating in the traffic flow. The status of the vehicle doors as well as the current gear selection, supply, for example, information as to whether or not persons are entering or leaving the vehicle (door opens).

Parking operations can be detected by analyzing the steering angles in connection with the speed. Data from the digital map supply information as to whether the vehicle is even traveling on a public road or is situated, for example, in a large parking lot, a rest stop or a gas station.

The flow chart of the software module 100 for determining the scope of the detected traffic condition uses the following successively implemented comparisons in order to find clues that the vehicle is not moving in a normal manner in road traffic. In Comparison 101, it is checked whether the door has been opened; in Comparison 102, it is checked whether a POI (point of interest) is in the vicinity; in Comparison 103, it is checked whether a high steering activity is present; in Comparison 104, it is checked whether the reverse gear or the idling gear of the vehicle is engaged; in Comparison 105, it is checked by means of the data supplied by the navigation system (not shown) whether the vehicle is situated off the road; in Comparison 106, it is checked whether the hand brake is applied; in Comparison 107, it is checked whether the airbag has been triggered. If the result of one or more of these comparisons is positive, or the reply to one of Comparisons 101 to 107 is "yes", this is evaluated to be an indication that the vehicle is moving in a situation or is stopped in a situation which should not be taken into account when detecting a traffic jam or when detecting an unimpeded travel or "go".

If one or more of Comparisons 101 to 107 is/are positive—a comparison preferably takes place every second—a counter 108 is increased by "1". If, for example, the door is opened, Comparison 101 will result in a first "yes" and the counter is set to "1". During the next second, a new comparison 101 takes place and, when the door is open, the counter is set to "2", etc. If the door is closed, the result is "no", and Comparison 102 takes place during the next second. If the result is "yes", the counter is increased by "1" to "3". If no positive comparison takes place when passing through Comparisons 101 to 107, the reading of the counter is set back to "0". Each positive comparison therefore increases the reading of the counter 108; however, only until a passing through Comparisons 101 to 107 occurs, during which the result of the comparisons was always "no". If applicable, the counter 101 is set to "0", as indicated in 109.

In this embodiment, the value t1 in a Comparison 110 is defined to be "60". If the reading of the counter 108 does not reach the reading "60", the result of Comparison 110 is "no", and the detection as to whether or not a traffic jam is present, is suspended, as indicated by the "PAUSE Detection" 111. If the result of Comparison 110 is "yes"; that is, one of the conditions of Comparisons 101 to 107 is present longer than 60 seconds, a resetting of the detection of whether or not a traffic jam is present is carried out. This is indicated by the "RESET detection" 112. How the "RESET detection" is carried out or what it causes, will be explained later in connection with FIG. 5. If the result of Comparisons 101 to 107 has always been "no", this is considered to be a situation in which no exceptional condition exists and, as described in detail in the following, the traffic jam detection is carried out. This is indicated by the "GO detection" 113.

It is advantageous to carry out the Comparisons 101 to 107 successively—instead of a parallel implementation of the comparisons (not shown)—, because, in the case of at least one positive comparison, the subsequent comparisons are no longer carried out, which saves computing time or hardware resources. Likewise, the passing through Comparisons 101 to 107 can also be carried out in a different order. For example, the inquiry 108 as to whether the hand brake is applied can be carried out before the inquiry 101 as to whether the door is open.

Figure 2:
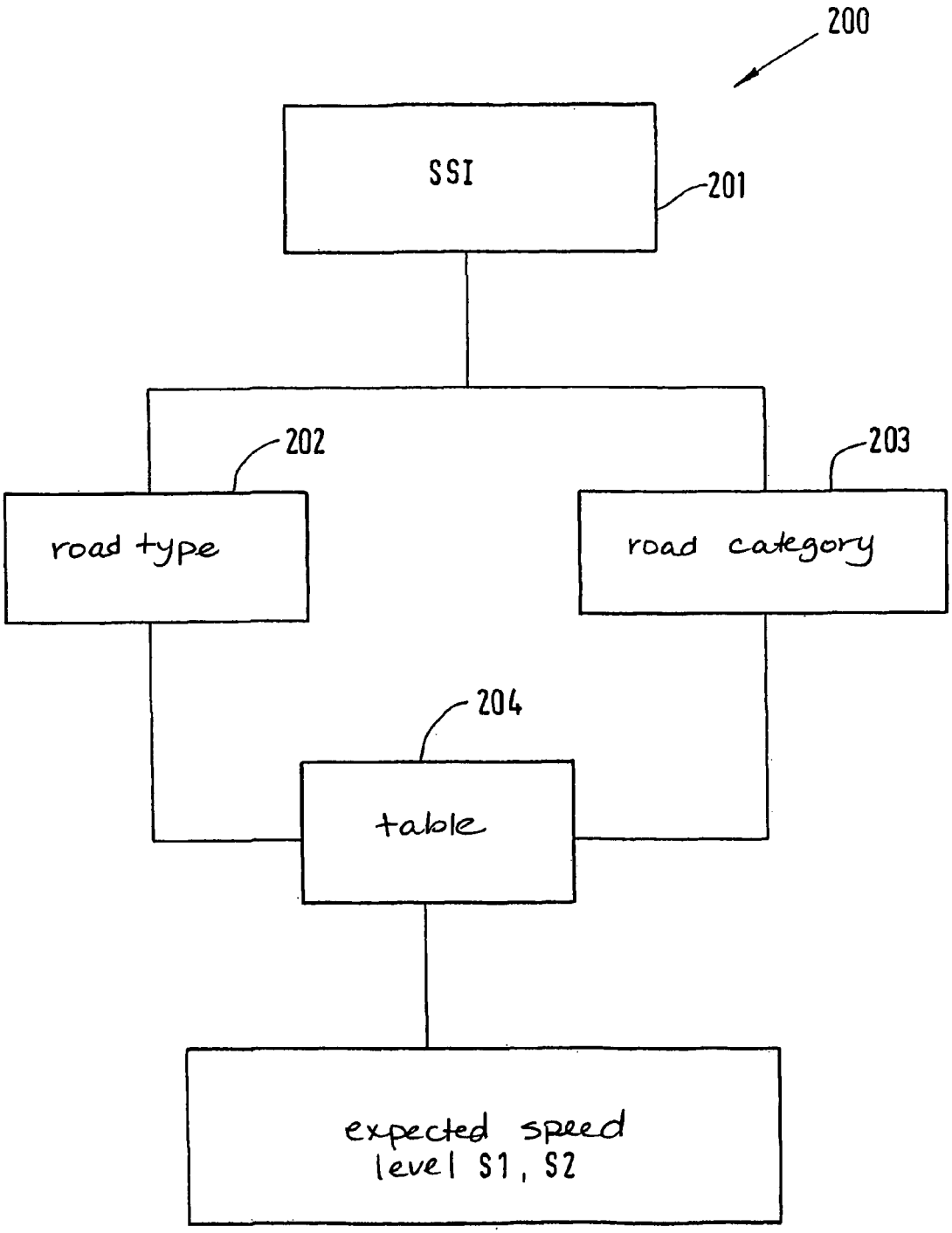
FIG. 2 is a flow chart of a software module for determining the speed level to be expected.

FIG. 2 is the flow chart of the software module 200 for detecting the speed level to be expected. The known standard sensor interface (SSI) 201 supplies the road type 202 and the road category 203 for all roads and the normal speed for some roads by means of a digital map (not shown) containing this information. With respect to all roads, it is indicated on the digital map, normally a DVD of the navigation system, to which road type 202 and to which road category 203 the concrete road belongs. According to the invention, with respect to roads for which the normal speed is not available, the speed level to be expected is assigned as a normal speed by means of a Table 204 with entries for the different "road types" and for the different "road categories".

Table 204 has a lower speed threshold S1 and an upper speed threshold S2 for the corresponding road type and the corresponding road category. If the vehicle is on a fast road, the normal speed, for example, corresponding to the permissible maximal speed, is particularly approximately 100 km/h. The lower speed threshold S1 is in each case defined in the table with 35 km/h and the upper speed threshold S2 is defined with 45 km/h. This is an empirical value which is based on the assumption that below 35 km/h, there is the probability of a traffic disturbance; at a speed of from 35 to 45 km/h, there may be a traffic disturbance; and at a speed of more than 45 km/h, there is probably no traffic disturbance or traffic jam. Corresponding information is also listed in the table for the other road categories depending on the road type.

The normal speed for the concrete road may also be indicated on the digital map. In a contemplated embodiment, the lower speed threshold S1 is fixed at 35% of the normal speed and the upper speed threshold S2 is fixed at 45% of the normal speed. The lower speed threshold S1 and the upper speed threshold S2 are therefore oriented according to the normal speed.

The following Table 204 indicates preferred empirical values:

| Road Category (S1/S2) according to SSI | In-Town (S1/S2) [km/h] | Out-of-Town [km/h] |
|---|---|---|
| 0 not specified | as before | as before |
| 1 highway | — | 46/60 |
| 2 fast road | 15/25 | 35/45 |
| 3 regional road | 15/25 | 30/40 |
| 4 main road | 15/25 | 30/40 |
| 5 local road | 15/25 | 30/40 |
| 6 connecting road | 15/25 | 30/40 |
| 7 slow road | 10/20 | 25/35 |
| 8 minor road | 10/20 | 25/35 |
| 9 service road | 10/20 | 25/35 |

Figure 3:
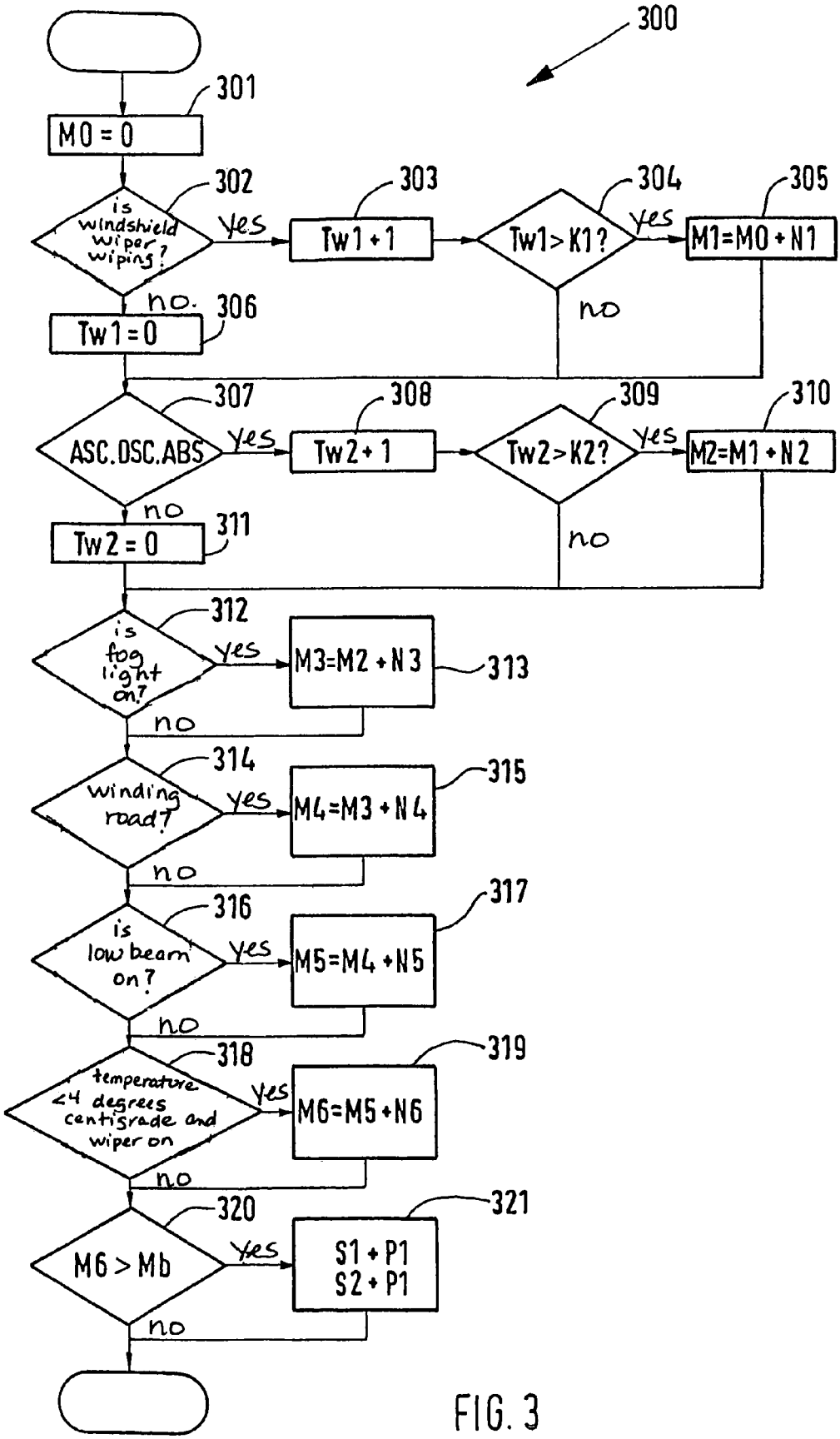
FIG. 3 is a flow chart of a software module for determining the marginal conditions of weather and road characteristics.

The speed thresholds S1 and S2 are given to a software module for detecting the marginal conditions of weather and road characteristics corresponding to FIG. 3, which, as required, adapts the speed thresholds to the marginal conditions.

It is understood that these values are empirical values which may preferably be selected in order to optimize the reliability of the traffic jam detection. Likewise, the speed thresholds S1 and S2 can then also be selected by means of the table if the normal speed is indicated in the digital map.

In a supplementary fashion, the upper and the lower speed threshold, as a function of the current vehicle position and/or the current time of day and/or the current traveling direction, can be transmitted by a traffic data control center into the vehicle and can be used temporarily instead of the original table values. In order to minimize the data volume to be transmitted, the traffic data control center may only transmit deviations of the values filed in the vehicle (table, navigation chart data). Current temporary conditions, such as day-time construction sites, current indications of change-traffic signals or night-time speed limits (noise reduction) are advantageously taken into account without the requirement of having to reduce the sensitivity of the traffic jam recognition.

Figure 6:
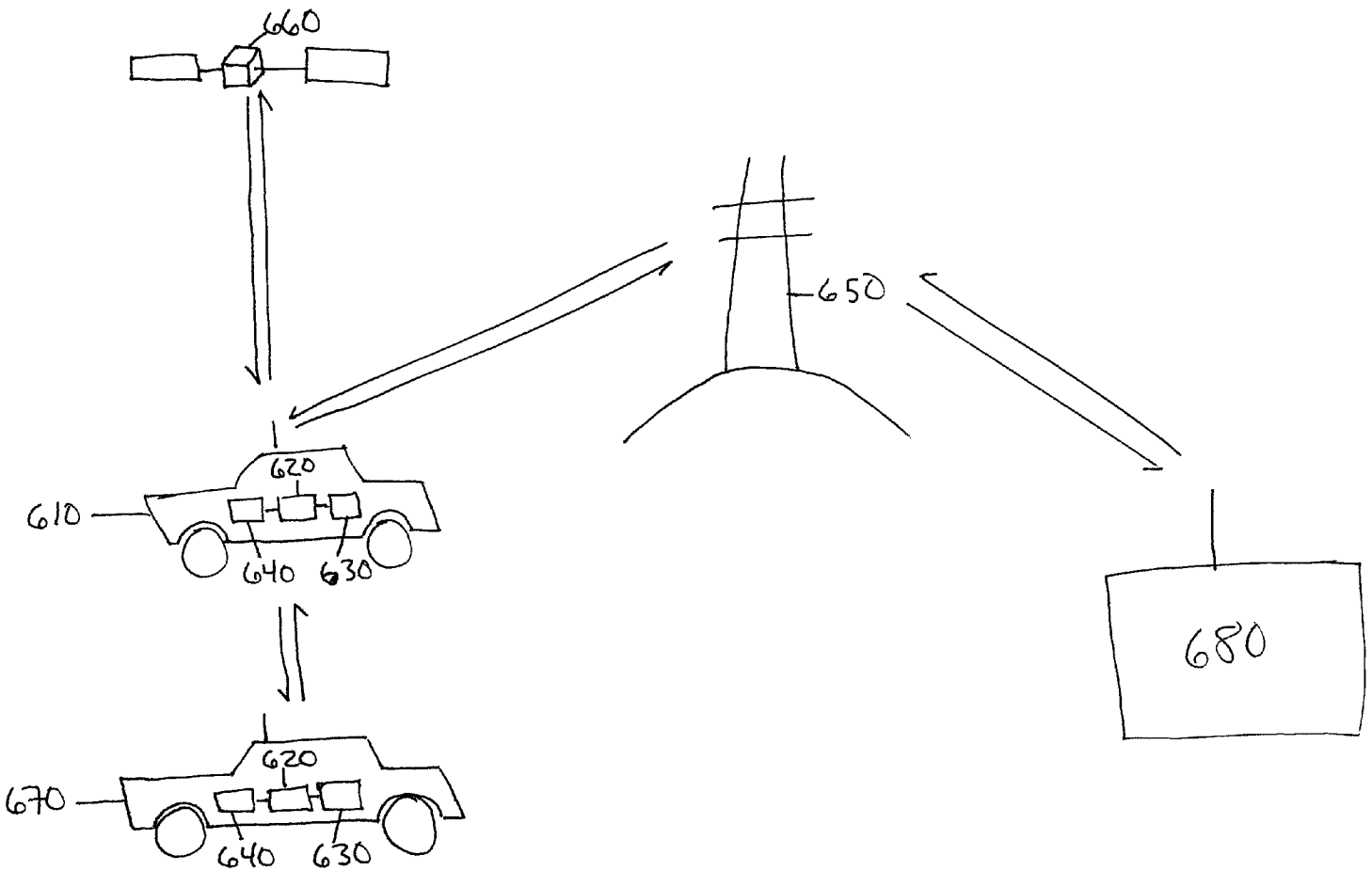
FIG. 6 is a schematic illustration of a traffic condition system in accordance with an embodiment of the present invention.

In a supplementary fashion, the upper and the lower speed threshold, as a function of the current vehicle position and/or the current time of day and/or the current traveling direction, can be transmitted by a traffic data control center (FIG. 6, 680) into the vehicle (FIG. 6, 610, 670) and can be used temporarily instead of the original table values. In order to minimize the data volume to be transmitted, the traffic data control center may only transmit deviations of the values filed in the vehicle (table, navigation chart data). Current temporary conditions, such as day-time construction sites, current indications of change-traffic signals or night-time speed limits (noise reduction) are advantageously taken into account without the requirement of having to reduce the sensitivity of the traffic jam recognition.

FIG. 3 is a flow chart of the software module 300 for the detection of the marginal conditions of weather and road characteristics.

Figure 5:
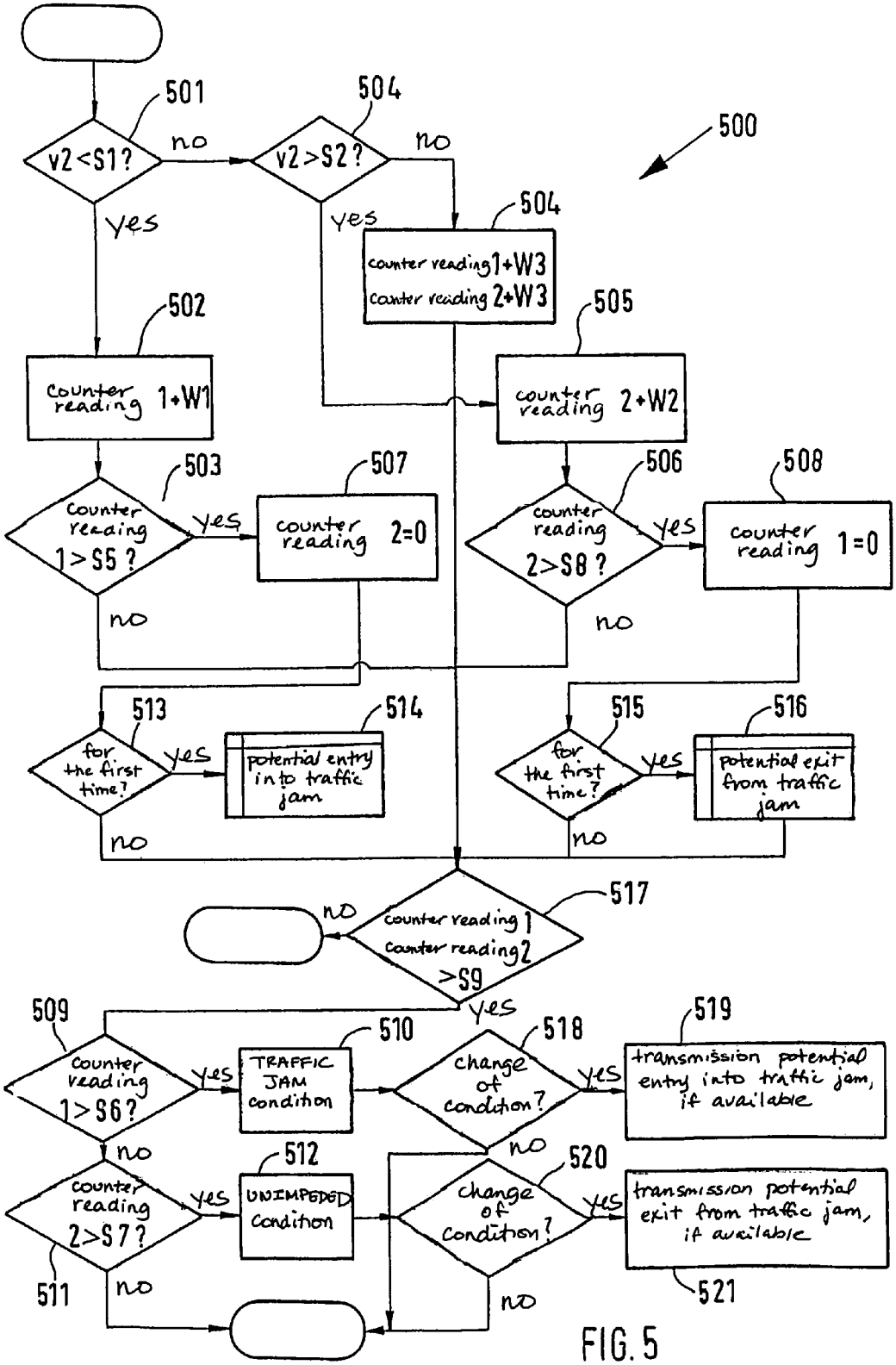
FIG. 5 is a flow chart of a software module for detecting the traffic condition.

The SSI data:

Wiper Switch
- Wiper frequency
- Lateral acceleration
- ABS
- ASR/DSC
- Steering angle
- Temperature
- Light
- Fog light permit the estimation of marginal and environmental conditions, such as falling snow, rain, slipperiness or winding roads. In the event of a considerable occurrence of one of these marginal conditions, the threshold values S1 and S2 for the traffic condition recognition described in FIG. 5 are correspondingly adapted.

In Step 301, the value M—a value indicating the seriousness of the existing marginal conditions—, is set to "0"; that is, the initial value for M is MO=0. A passing through the chain illustrated in FIG. 3 takes place in the timing of seconds. In Step 302, it is compared whether the windshield wiper of the vehicle is wiping. If the result of Comparison 302 is "yes", a value Tw1, which indicates the duration of the windshield wiper activity, is increased in Step 303 by the value "1". In Step 304, it is compared whether the current value of Tw1 is higher than a value K1, which indicates a lower time threshold K1. If the windshield wiper operates longer than the lower time threshold K1; that is, the result of Comparison 304 is "yes", the value M0 in Step 305 is increased by the value N1; M1=M0+N1. N1 is a value which expresses the extent of the influence on the speed of the vehicle that is normal without disadvantageous marginal conditions, and thus represents a weight value for the condition "windshield wiper is wiping". After the addition of N1 in Step 305, the process is continued by means of the subsequent steps.

If the windshield wiper is not wiping, Comparison 302 results in a "no", and the value Tw1 is set to "0" in Step 306. In this case, in the event that Comparison 304 had the answer "no", or in the event that M1=M0+N1 was added, the continuation takes place in Step 307. If the result in Step 302 was "no", the value of Tw1 is set back to "0".

In Step 307, the data supplied by the SSI are checked as to whether the ASC, the DCS or the ABS is intervening. The result of Comparison 307 may possibly be "yes". Since the passing through the chain illustrated in FIG. 3 takes place every second, the value Tw2 is increased by the value "1" every second in Step 308, if the intervention continues to exist. If the value of Tw2 is greater than a lower time threshold K2, the result of Comparison 309 is "yes" and the value N2 is added in Step 310 to the value M1 from Step 305; that is, M2=M1+N2. N2 is a value which expresses the extent of the influence on the speed of the vehicle that is normal without disadvantageous marginal conditions and thereby represents a weight value for the condition "ASC, DCS or ABS active". If the result of Comparison 307 is "No", Tw2 is set to "0" in Step 311.

In the next Step 312, it is checked whether the fog light is switched on. Should the result of Comparison 312 be "yes", the value N3 is added in Step 313 to the value M2 from Step 310; that is, M3=M2+N3. N3 is a value which expresses the extent of the influence on the speed of the vehicle that is normal without disadvantageous marginal conditions, and thereby represents a weight value for the condition "fog or fog light on."

If the result of the comparison in Step 312 was "no", or if the value N3 was added in Step 313, Step 314 is executed. In this step, it is checked, whether a winding route is involved. This can be determined by means of the data concerning the steering angle and its time variation supplied by the SSI. If the result of Comparison 314 is "yes", the value N4 is added to the value M3 in Step 315; that is, M4=M3+N4. If the result of Comparison 314 is "no" or Step 315 was executed, the continuation takes place by means of Step 316. N4 is a value which expresses the extent of the influence on the speed of the vehicle that is normal without disadvantageous marginal conditions, and thereby represents a weight value for the "winding route" condition.

In Step 316, it is checked whether the low beam is switched on. As an alternative, it could be checked by means of a daylight sensor whether it is dark and the low beam should be switched on. Such a sensor, which automatically switches on the low beam when it is dark, is known as optional "driving light control" equipment. If it is determined that the low beam is switched on or should be switched on because it is dark, the result of Comparison 316 will be "yes", and the value N5 is added to the value M4 in Step 317; that is, M5=M4+N5. N5 is a value which expresses the extent of the influence on the speed of the vehicle that is normal without disadvantageous marginal conditions, and thereby represents a weight value for the "darkness or low beam," condition.

If the result of the comparison is "no" or N5 was added in Step 317, the continuation takes place in Step 318. In Step 318, it is checked whether the temperature is lower than 4 degrees centigrade and, in addition, the windshield wiper is switched on. Should the result of Comparison 318 be "yes", the value N6 is added to the value M5; that is, M6=M5+N6. N6 is a value which expresses the extent of the influence on the speed of the vehicle that is normal without disadvantageous marginal conditions, and thereby represents a weight value for the "temperature lower than 4 degrees centigrade and, in addition, windshield wiper switched on" condition.

If the result of the Comparison is "no" or N6 was added in Step 319, the continuation takes place in Step 320.

In Step 320, it is checked whether the value M6 is greater than a defined value Mb. Mb is an empirical value or is determined, for example, by test runs and indicates starting from of which value a lower speed is expected because of the above-mentioned marginal conditions in comparison to the normal speed. If the result of Comparison 320 is "yes", the lower speed threshold S1 and the upper speed threshold S2 from the software module 200 for the determination of the speed level to be expected is in each case reduced by a multiplication by a value P1 which is lower than 1. In practice, it was found that a value P1 of approximately 0.9 is suitable;

that is, that the S1 and S2 should be reduced to approximately 90% of their normal value in the case of the above-mentioned marginal conditions.

In the next step, a passing through the chain illustrated in FIG. 3 again (preferably) takes place approximately every second, unless it is determined that the vehicle is outside the scope of the traffic jam detection according to the invention (compare FIG. 1).

These values for S1 and S2, which may have been reduced by the above-mentioned marginal conditions, represent the values for S1 and S2 in FIG. 5 which are illustrated by the flow chart of the software module for detecting the traffic condition. It hereby avoided that unfavorable marginal conditions which result in a reduction of the traveled speed without the existence of a traffic jam, lead to a supposed recognition of a traffic jam.

Figure 4:
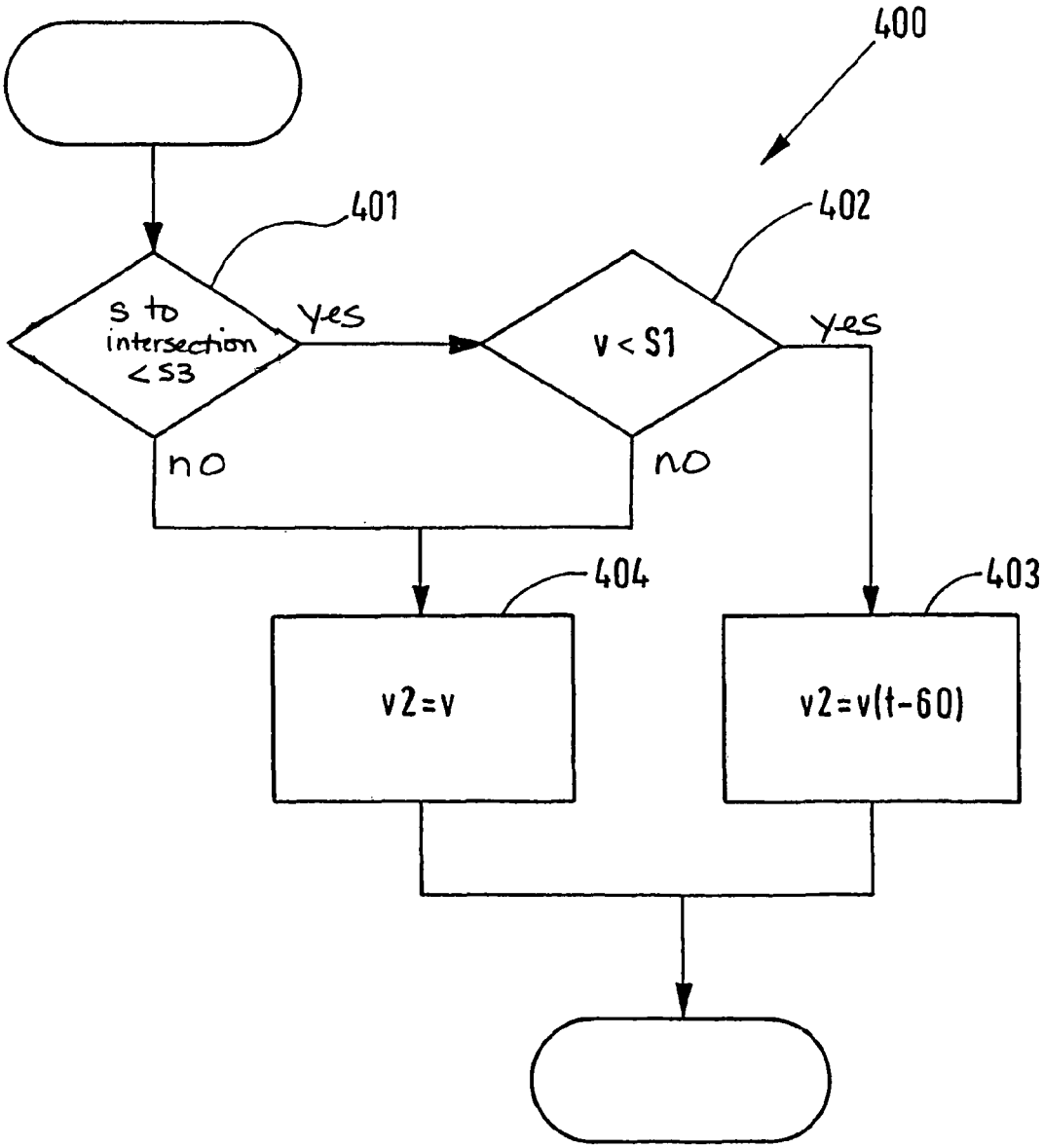
FIG. 4 is a flow chart of a software module for detecting intersection areas.

Furthermore, the correspondingly reduced value for S1 is used instead of the value S1 in FIG. 4 which is shown by the flow chart of a software module for the detection of intersection areas.

FIG. 4 shows the flow chart of a software module 400 for the detection of intersection areas. Delays in the travel flow which occur as a result of intersections, whether they are controlled by traffic signals or not, are detected as such and are filtered out if the delay is normal and the intersection is subsequently crossed. Thus, a virtually intersection-free traveling profile is endeavored which permits the condition recognition also in intersection areas. The SSI data "distance to the next intersection" (from the navigation system with a digital map) and "speed" are used for this purpose. A traffic jam in front of an intersection area is identified in the current traffic condition recognition, FIG. 5.

In Step 401, it is checked whether the distance s of the vehicle to the next intersection is shorter than a defined distance S3. On the basis of test runs, currently a value of approximately 160 m preferably seems suitable for S3. If the result of the comparison is "yes", it is checked in Step 402 whether the speed v of the vehicle is lower than the currently applicable lower speed threshold S1. As indicated above, this may be the reduced value for S1 (compare FIG. 3). If the result of the comparison is "yes", not the current speed v of the vehicle will be transmitted as speed v2 to the traffic condition recognition of FIG. 5 but, in Step 403, the average speed of the vehicle during the last 60 seconds before the comparison in Step 402; that is v2=v (t−60). This average speed v2 is therefore a speed freed of intersections (modified speed).

If the result of the comparison 401 is "no", that is, the vehicle is not traveling in the area of an intersection, the current speed v of the vehicle is transmitted as speed v2 in Step 404 to the traffic condition recognition of FIG. 5.

In the next step, a passing through the chain illustrated in FIG. 4 again (preferably) takes place approximately every second, unless it is determined that the vehicle is outside the scope of the traffic jam detection according to the invention (compare FIG. 1).

FIG. 5 finally is the flow chart of a software module 500 for the recognition of the traffic condition by means of a threshold value method; that is, for determining whether a traffic jam is occurring or whether the travel is unimpeded. In addition, the software module 500 according to the invention permits the determination of a position indication for driving into the traffic jam and a position indication for driving out of the traffic jam.

Following Steps 111 (PAUSE detection), 112 (RESET detection) or 113 (GO detection), it is checked whether the "PAUSE detection" is present. If the result is "no", a passing through the process steps illustrated in FIG. 5 takes place without any change of the counter readings of the counters described in the following. If the result is "yes", it is checked whether the "RESET detection" is present. If the "RESET detection" is present, that is, the result of this comparison is "yes", the readings of the two counters described in the following are each set back to the "0" reading, and the process steps of FIG. 5 are then continued with "0" counter readings. If no "RESET detection" is present, the process steps of FIG. 5 after the pause (PAUSE detection) are continued with the counter readings existing at this point in time.

Summarizing, the basic data for the threshold value method carried out by the software module 500 are the data determined from the above four software modules and the current speed data of the vehicle. The software module 500 is executed on a device 620 of the vehicle 610, and may be stored in an associated storage device 640, for example a DVD-based storage similar to a navigation system DVD storage. If the software module 100 (scopes) determines that the vehicle is not participating in the traffic flow, the traffic condition recognition according to FIG. 5 is suppressed. After a participation in the traffic has been determined, the module data are used for the modification of the speed values v2 and for the determination of the current threshold values S1 and S2. The speed data are changed by way of the determined marginal conditions of weather, road condition and road characteristics (intersections, winding roads). The modified speed data are used for the further computations. The threshold values are determined by way of the desired speed (software module 200). They divide the entire speed range into three parts: Speed v lower than S1, v between S1 and S2, and v greater than S2. The modified speed data are assigned to one of the three ranges preferably every second. The determination of the currently prevailing traffic condition then takes place by way of the frequencies of the modified speed data in the individual ranges. Traffic light and intersection areas are already taken into account by the modification of the speed data. Traffic jams in traffic light or intersection areas are detected in the same manner as in areas without intersections.

In the first Step 501 of the flow chart of the software module 500, it is checked whether the speed v2 (possibly a speed of FIG. 4 freed of intersections) is lower than the lower speed threshold S1 (possibly modified by the marginal conditions of weather, road condition and road characteristics). If the result of comparison 501 is "yes", which is considered to be an indication that there is a traffic jam, a counting-up takes place in Step 502, starting from the counter reading "0", by means of a first counter, by the value W1 (counter reading 1+W1). The first counter therefore takes into account a low speed v2<S1 of the vehicle. Since a passing through the flow chart (preferably) takes place every second, a counting-up takes place every second when the result of the comparison stays the same. Preferably, the counter reading in Step 502 may increase every second by the value "1"; that is, preferably W1=1. Naturally, another value, such as "0.5", could also be added. The reading of the counter in Step 502 is compared with a value S5 in Step 503 (counter reading 1>S5).

If the result of Comparison 501 is "no", that is, v2 is lower than the lower speed threshold S1, it is checked in Step 504 whether the (possibly modified) speed of the vehicle v2 is lower than the upper speed threshold S2. If the result of Comparison 504 is "yes", which is considered to be an indication that the travel is unimpeded or that there is no traffic jam, a counting-up takes place in Step 505, starting from the counter reading "0" by means of a second counter by the value W2 (counter reading 2+W2). The second counter therefore takes into account a high speed v2>S2 of the vehicle.

Since a passing through the flow chart (preferably) takes place every second, a counting-up takes place every second when the result of the comparison remains the same. Preferably, the counter reading of the second counter may rise every second by the value "1" in Step 505; that is, W2 is preferably "1". Naturally, another value, such as "0.5", may also be added. The reading of the second counter in Step 505 is compared with the value S8 in Step 506. If the result is "yes", the reading of the first counter is set to "0" in Step 508. If the result is "no", the continuation takes place in Step 517.

Thus, starting from Comparison 501, in the case of a traffic jam, the first counter is advanced in Step 502. The reading of the first counter may possibly exceed the value S5, and the result of Comparison 503 is "yes". Then, in Step 507, the second counter, which counts how many second of unimpeded travel are occurring, is set back to "0" (counter reading 2=0). Starting from Comparison 504, when travel is unimpeded, the second counter is advanced in Step 505 (counter reading 2+W2). The counter reading of the second counter may exceed the value S8, and the result of comparison 506 is "yes". Then, in Step 508, the first counter, which how many seconds the traffic jam is present, is set back to "0" (counter reading 1=0).

In Step 513, it is checked whether the reading of the second counter (counter reading 2) was set back to "0" for the first time in Step 507. If the result is "yes", in Step 514, the location and point in time is stored at which the reading of the counter 1 in Step 503 was greater than the value S5 (potential entering into the traffic jam). It is potential because it first has to be shown in Step 509 whether a traffic jam is currently present. It is checked in Step 515 whether the reading of the first counter (counter reading 1) in Step 508 was set back to "0" for the first time. If the result is "yes", in Step 516, the location and point in time is stored at which the reading of the counter 2 in Step 506 was greater than the value S8 (potential exiting of the traffic jam). It is potential because it first has to be shown in Sep 511 whether there is currently no traffic jam.

Following Steps 513, 514, 515 and 516, it is in each case checked in Step 517, whether the absolute amount of the difference between counter reading 1 and counter reading 2 is greater than a value S9 (| counter reading 1 −counter reading 2|>S9). If the result of the comparison is "yes", Step 509 is executed. If the result of the comparison is "no", Step 509 is not executed, and the process chain illustrated will start again with Step 501, as in the passing-though preferably occurring in seconds.

If the speed v2 is between S1 and S2, the result of the comparison in Step 504 is "no". This situation is considered to be an undefined condition; that is, it is not clear whether a traffic jam is present or whether there is no traffic jam or the travel is unimpeded.

If the reading of the first counter is lower than S5 or equal to S5, the result of Comparison 503 will be "no".

In Step 504', the reading of the first counter is then increased by the value W3, and the reading of the second counter is then also increased by the value W3, possibly in seconds, if the passing through the chain illustrated in FIG. 5 takes place in seconds. Preferably, W1 and W2 have the same value, W3 preferably having half the value of W1 or W2. Preferably, the value of W1 or W2 is "1", and the value of W3 is "0.5". It is understood that also another weighting can be used if this leads to a more reliable detection of a traffic jam.

The reading of the first counter (low speed) is compared every second in Step 509 with the value S6 (counter reading 1>S6). If the reading of the first counter is greater than S6 and the result of the comparison is "yes", a first data record is created in Step 510 which describes the "traffic jam" condition. In Step 518, it is checked whether a change of condition is present; that is, whether the "traffic jam" condition was preceded by an "unimpeded" condition. During each new start of the vehicle, the "unimpeded" condition is defined as the starting condition. If the result of the comparison is "yes", the first data record and the location and the time of the (previously only potential) entering of the traffic jam are transmitted in Step 519 for the purpose of the data inquiry to an institution reconstructing and representing the traffic situation, particularly a traffic data control center (FIG. 6, 680), preferably a regional traffic data control center, preferably by SMS (a form of mobile (cellular) communication via antennas 650).

If the reading of the first counter is smaller than or equal to a value S6, the result of the comparison is "no". It is optionally checked in Step 511 whether the reading of the second counter is greater than a value S7. If the result of the comparison is "yes", a second data record is generated in Step 512 which describes the "unimpeded" condition. In Step 520, it is checked whether a change of condition is present; that is, whether the "traffic jam" condition preceded the "unimpeded" condition. If the result of the comparison is "yes", the second data record and the location and the time of the (previously only potential) exiting from the traffic jam in Step 21 is transmitted for the purpose of the data inquiry to an institution reconstructing and representing the traffic situation, particularly a traffic data control center, preferably a regional traffic data control center, preferably by SMS.

If the result of the comparisons in Steps 518 or 520 is "no", no data transmission takes place. On the contrary, the process described in FIG. 5 starts again in Step 501.

If the reading of the first counter (entering the traffic jam) in step 509 is lower or equal to S6, the result of Comparison 509 will be "no". It will then be checked in the next Step 511 whether the reading of the second counter (driving out of the traffic jam or unimpeded travel) is greater than or equal to S7. If the reading of the second counter is greater than or equal to S7, the result of the comparison will be "yes", and the "unimpeded" condition in Step 512 will be transmitted for the purpose of the traffic situation inquiry to the institution constructing and representing the traffic situation, preferably again by SMS.

After the output of the "traffic jam" or "unimpeded" condition or when Comparison 511 is "no", a passing through the chain illustrated in FIG. 5 will again take place.

In order to determine the location of the entry into the traffic jam and to be able to transmit the latter to the institution reconstructing and representing the traffic situation (not shown), following the setting-back of the second counter in Step 507, it is checked in Step 513 whether it is a first passing-through or whether this Comparison 513 is carried out for the first time. If the second counter was set back to "0" for the first time in Step 507, the result of Comparison 513 will be "yes", and the position of the vehicle at this point in time determined by means of the data of the navigation system is stored as "entering of the traffic jam" in Step 514. When the "traffic jam" condition is transmitted in Step 510, preferably the position of the vehicle stored in Step 514, that is, "the entering of the traffic jam", is also transmitted to the institution reconstructing and representing the traffic, preferably by SMS.

In order to also determine the location of the exit from the traffic jam and to be able to transmit the latter to the institution reconstructing and representing the traffic situation (not shown), following the setting-back of the first counter in Step 508, it is checked in Step 515 whether it is a first passing-through or whether this Comparison 515 is carried out for the first time. If the first counter was set back to "0" for the first time in Step 508, the result of Comparison 515 will be "yes", and the position of the vehicle at this point in time determined by means of the data of the navigation system is stored as "exiting the traffic jam" in Step 516. When the "unimpeded" condition is transmitted in Step 512, preferably the position of the vehicle stored in Step 516, that is, "the exiting from the traffic jam", is also transmitted to the institution reconstructing and representing the traffic, preferably by SMS.

If the result of Comparison 513 or 515 is "no" or if the "driving into the traffic jam" was stored in Step 514 or the "exiting from the traffic jam" was stored in Step 516, the continuation takes place by means of the comparison in Step 509.

Preferably, a value of approximately 60 seconds is selected for S5, and a value of approximately 180 seconds is selected for S6 and S7. It is understood that also values other than these practical values can be selected if they permit a more reliable detection of traffic jams.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of providing traffic condition data in the context of a traffic condition recognition by a motor vehicle, the motor vehicle having a device for recognizing the position by using a digital road map stored on a data carrier, the method comprising the steps of:

determining a type of road on which the vehicle is traveling by using the position recognition device and the digital road map;

determining a category of the road on which the vehicle is traveling by using the position recognition device and the digital road map;

using an assignment in the form of a table to assign at least one lower speed threshold (S1) and one upper speed threshold (S2) to the corresponding road type as well as to the corresponding category of the road on which the vehicle is traveling;

using at least the lower speed threshold and the upper speed threshold for determining the traffic condition; and providing the determined traffic condition to at least one of a vehicle driver or a traffic data control center for at least one of review or retransmission to other vehicles.

2. The method according to claim 1, wherein current values or values which will soon be current for the upper and lower speed threshold, as a function of the current vehicle position and the time of day, are transmitted from outside the vehicle into the vehicle by a traffic data control center, and the current values or values which will soon be current received from outside the vehicle are temporarily used instead of original values.

3. The method according to claim 2, wherein the transmission of the current values for the lower and upper speed threshold for a route section currently traveled or soon to be traveled into the vehicle takes place by way of a wireless communication.

4. The method according to claim 3, wherein the wireless communication is one of: a mobile communication and a radio communication, the communication including at least one of SMS, TMC, DAB, DVB-T, GPRS, UMTS, and a satellite communication.

5. The method according to claim 2, wherein the original values are taken from a storage device in the vehicle, and only the current values or the values which will soon be current are transmitted into the vehicle.

6. The method according to claim 5, wherein the storage device is a DVD.

7. The method according to claim 1, wherein the road type and the road category are provided via a standard sensor interface (SSI).

8. The method according to claim 1, wherein the following road types are provided: "highway", "fast road", "regional road", "main road", "local road", "connecting road", "slow road", "minor road" and "service road".

9. The method according to claim 1, wherein the following road categories are provided: "in-town" and "out-of-town".

10. The method according to claim 8, wherein the following road categories are provided: "in-town" and "out-of-town".

11. The method according to claim 1, wherein a normal speed is assigned to the determined road type, as a function of the determined road category, and the lower speed threshold (S1) is defined at approximately 35% of the normal speed and the upper speed threshold (S2) is defined at approximately 45% of the normal speed.

12. The method according to claim 1, wherein the normal speed of the road at the vehicle's current position is provided by the device for recognizing the position by using a digital road map stored on a data carrier, and the lower speed threshold (S1) is defined at approximately 35% of the normal speed and the upper speed threshold (S2) is defined at approximately 45% of the normal speed.

13. A system for transmitting traffic condition data from a first vehicle to a second vehicle by way of an ad-hoc network or from a traffic data control center to one or more motor vehicles by way of broadcasting, wherein the data concerning the traffic conditions are obtained by the method according to claim 1.

14. A device in a motor vehicle for generating and emitting traffic condition data, wherein the device carries out the method according to claim 1.

15. A computer program product for use in a motor vehicle and for generating and emitting traffic condition data, comprising a computer readable medium having stored thereon program code to perform the method according to claim 1.

16. The method according to claim 15, wherein the traffic condition data includes data for detecting a traffic situation, including a traffic jam.

* * * * *